US006068135A

United States Patent [19]

Holztrager

[11] Patent Number: 6,068,135

[45] Date of Patent: May 30, 2000

[54] MERCHANDISE DISPLAY PANEL WITH LOCKABLE DISPLAY CARD

[75] Inventor: William J. Holztrager, Bristol, Tenn.

[73] Assignee: Showall, Inc., Chilhowie, Va.

[21] Appl. No.: 09/215,785

[22] Filed: Dec. 21, 1998

[51] Int. Cl.[7] ..... G09F 3/18; E05B 73/00

[52] U.S. Cl. ..... 211/4; 211/94.01; 40/661.03; 312/128

[58] Field of Search ..... 211/4, 82.2, 87.01, 211/94.01, 189; 312/114, 128, 245, 131, 132; D3/903; D9/414; 40/649, 651, 657, 661.03, 661.04, 124.05, 124.06; 206/6.1, 566

[56] References Cited

U.S. PATENT DOCUMENTS

| | | | |
|---|---|---|---|
| D. 250,157 | 11/1978 | Kelly | D6/468 |
| D. 250,158 | 11/1978 | Kelly | D6/468 |
| D. 315,248 | 3/1991 | Marshall | D3/315 |
| 2,608,012 | 8/1952 | Jackson | 211/87.01 |
| 3,516,719 | 6/1970 | Weisblat | 211/4 X |
| 3,570,676 | 3/1971 | Crosslen | 211/4 |
| 3,695,452 | 10/1972 | Surman | 211/4 |
| 3,698,565 | 10/1972 | Weber | 211/87.01 |
| 3,805,962 | 4/1974 | Beniksen | 211/4 |
| 4,155,457 | 5/1979 | Wilbert | 211/4 |
| 4,322,007 | 3/1982 | Feibelman | 211/163 |
| 4,391,375 | 7/1983 | Joyce . | |
| 4,442,942 | 4/1984 | Cuminale et al. . | |
| 4,579,308 | 4/1986 | Jensen | 211/87.01 X |
| 4,693,381 | 9/1987 | Lodge | 211/94.01 |
| 4,718,554 | 1/1988 | Barbato . | |
| 4,750,624 | 6/1988 | Baron | 211/87.01 |
| 4,771,897 | 9/1988 | Ho | 211/94.01 X |
| 4,854,656 | 8/1989 | O'Keefe . | |
| 4,944,389 | 7/1990 | Robertson . | |
| 5,172,815 | 12/1992 | Schock et al. | 211/85.2 |
| 5,224,610 | 7/1993 | Veazey | 211/87.01 |
| 5,242,048 | 9/1993 | Ellingsworth et al. | 206/6.1 |
| 5,392,934 | 2/1995 | Fox | 211/94.01 |
| 5,465,852 | 11/1995 | Koks et al. | 211/85.26 |
| 5,524,977 | 6/1996 | Orawski | 312/114 |
| 5,582,376 | 12/1996 | Thompson | 211/94.01 X |
| 5,593,025 | 1/1997 | Feibelman . | |
| 5,699,901 | 12/1997 | Cohen . | |
| 5,709,297 | 1/1998 | Brandriff et al. . | |
| 5,775,521 | 7/1998 | Tisbo | 211/94.01 |

*Primary Examiner*—Daniel P. Stodola
*Assistant Examiner*—Jennifer E. Novosad
*Attorney, Agent, or Firm*—Shlesinger, Arkwright & Garvey LLP

[57] ABSTRACT

A merchandise display assembly comprises first and second longitudinal profiles defining a groove therebetween, each profile including a flange portion having an upper edge portion for overlapping onto the edge portion of a display card hanger portion; and a member configured to be inserted into the groove, the member including a leg portion configured to be disposed in a space formed between adjacent flange portions such that the leg portion is disposed over the display card hanger portion, whereby the display card is restricted from being lifted from the edge portion.

18 Claims, 3 Drawing Sheets

FIG. 4
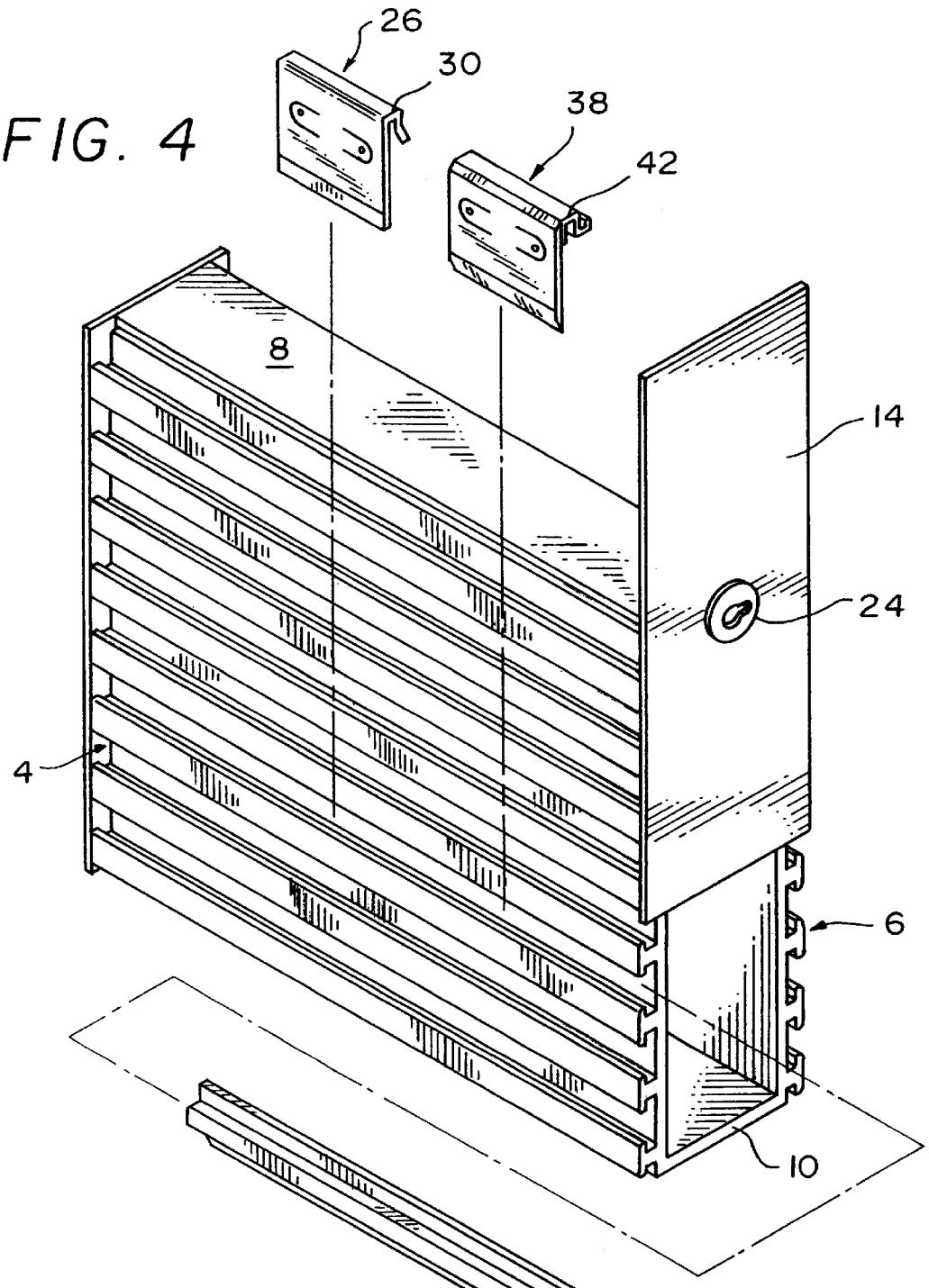
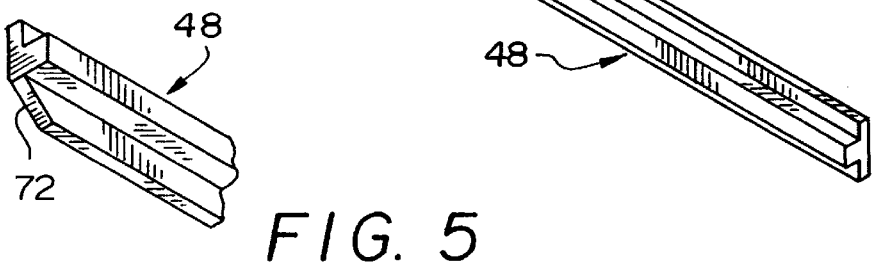
FIG. 5

MERCHANDISE DISPLAY PANEL WITH LOCKABLE DISPLAY CARD

FIELD OF THE INVENTION

This invention relates to an assembly for displaying jewelry or other valuable small articles attached to display cards. The invention specifically pertains to a merchandise display assembly for display cards that restricts unauthorized removal therefrom.

BACKGROUND OF THE INVENTION

Displaying jewelry and other valuable small articles of merchandise is often problematic, since the theft of these items is generally difficult to detect. Accordingly, these items are usually placed behind closed showcases or counters. However, displaying jewelry and other valuable items behind these showcases is inconvenient for both the customer and merchant. A salesperson is required to supervise the counter every time a customer desires to personally touch or look over the merchandise. Hence, a display device is desired that would allow a merchant or seller to confidently display valuable items without fear of theft.

A number of devices have attempted to openly display jewelry and other valuable merchandise. U.S. Pat. No. 5,172,815 to Schock is directed to a gravity feed jewelry display system and dual-flange display card. The system comprises pairs of inclined slots spaced apart to slidably receive the display cards such that when a lower card is pulled out, a card situated above slides down to occupy the position of the card just removed. However, these cards are easily removable from the display, which leaves valuable articles attached thereon prone to theft. Also, the system uses specially designed display cards rather than standard jewelry cards, which presents a problem should the display cards become lost.

U.S. Pat. No. 4,442,942 to Cuminale is directed to a carded merchandise display apparatus. The apparatus uses display cards, which are snapped onto rungs disposed on central and rotatable side uprights. The uprights and rungs are positioned such that removal of display cards requires rotating the side uprights and sliding the cards along the rungs. Although this device reduces the possibility of theft, the device uses specialized snap-on lockable display cards instead of standard display cards or standard jewelry cards. Also, the device uses gears to rotate the side uprights, which are prone to wearing down, and requires an additional base member to avoid friction against the support surface.

U.S. Pat. No. 4,854,656 to O'Keefe is directed to a jewelry storage apparatus. The apparatus is a cabinet having a T-shaped reciprocating shelf with holes and hooks attached thereon for tangle-free and orderly storage of different types of jewelry such as necklaces and earrings. However, the cabinet is unsuitable for displaying articles of jewelry attached on standard jewelry cards. Direct display of jewelry without additional security measures is not feasible with this apparatus.

Other devices relate to display of jewelry display cards. U.S. Pat. No. 4,391,375 to Joyce is directed to a display card and assembly hanger. The assembly hanger is configured to receive a display card from below. However, the display card is also easily removable from the hanger, which presents security problems. Similarly, U.S. Pat. No. 5,699,901 to Cohen is directed to an apparatus for distribution and display of jewelry and other similar articles. The apparatus includes a slug interfit into a slug holder having a hanger. However, the assembly is easily removable, as in standard jewelry display cards and does not provide any additional security measures.

Still other patents are directed to assemblies and methods of carding or assembling display cards. U.S. Pat. No. 4,944,389 to Robertson is directed to an earring and display card assembly and the assembly formed thereby. U.S. Pat. No. 4,718,554 to Barbato is directed to a method of carding pierced earrings and the assembly thereby formed. The completed assembly for both patents include a display card having a main card portion and hanger portion. Although the main card portion includes clutches for receiving earrings and a fabric layer, the hanger portion does not include additional anti-theft features.

Other patents are directed to the jewelry display cards. U.S. Pat. No. 5,709,297 to Brandriff is directed to a hanger display card having a first panel and a hanger integrated with the first panel and containing a second panel. However, the display card is made entirely of paper, which is tearable and prone to theft. U.S. Pat. No. 5,593,025 to Feibelman is directed to a foldable jewelry card having connected front, intermediate and rear panels with the rear panel comprising a supporting means or hook portion. Although this jewelry card hides the rear of the front panel to prevent removal of the jewelry from behind, the hook portions does not have any additional anti-theft features that would prevent the thief to remove the jewelry card.

As apparent from the above, there are jewelry display devices and jewelry cards with a standard hanger portion. None of these devices, however, provide anti-theft features using jewelry cards with a standard hanger portion. Accordingly, there is a need for a display device to provide these features. There is also a need for a jewelry card with an improved hanger portion for reducing theft.

OBJECTS AND SUMMARY OF THE INVENTION

It is an object of the present invention to provide a merchandise display panel or fixture for displaying jewelries and other small valuable items affixed to display cards wherein the display cards cannot be easily lifted from the display panel or fixture, allowing a retailer to display valuable merchandise in the open.

It is another object of the present invention to provide a merchandise display panel that requires the assistance of a sales clerk to remove a display card hanging onto the display panel.

It is still another object of the present invention to provide a display panel that makes a standard display card more tamper-resistant.

It is another object of the present invention to provide a display panel and a display card that is more resistant to unauthorized removal from a display panel than a standard display card.

In summary, the present invention provides a merchandise display assembly comprising first and second longitudinal profiles defining a groove therebetween, each profile including a flange portion having an upper edge portion for overlapping onto the edge portion a display card hanger portion; and a member configured to be inserted into the groove, the member including a leg portion configured to be disposed in a space formed between adjacent flange portions such that the leg portion is disposed over the display card hanger portion, whereby the display card is restricted from being lifted from the edge portion.

The present invention also provides an anti-theft display card for jewelries and the like on a display panel made up of a plurality of profiles. The display card includes a display portion; and a hanger portion having a first portion adapted to hook onto an upper edge of a profile, and a second portion adapted to be disposed within a groove formed between adjacent profiles.

These and other objects of the present invention will become apparent from the following detailed description.

BRIEF DESCRIPTION OF THE DRAWINGS

FIG. 4 is an exploded view of FIG. 1.

FIG. 5 is a fragmentary perspective view of a locking bar used in the present invention, showing a tapered forward end.

DETAILED DESCRIPTION OF THE INVENTION

Figure 1:
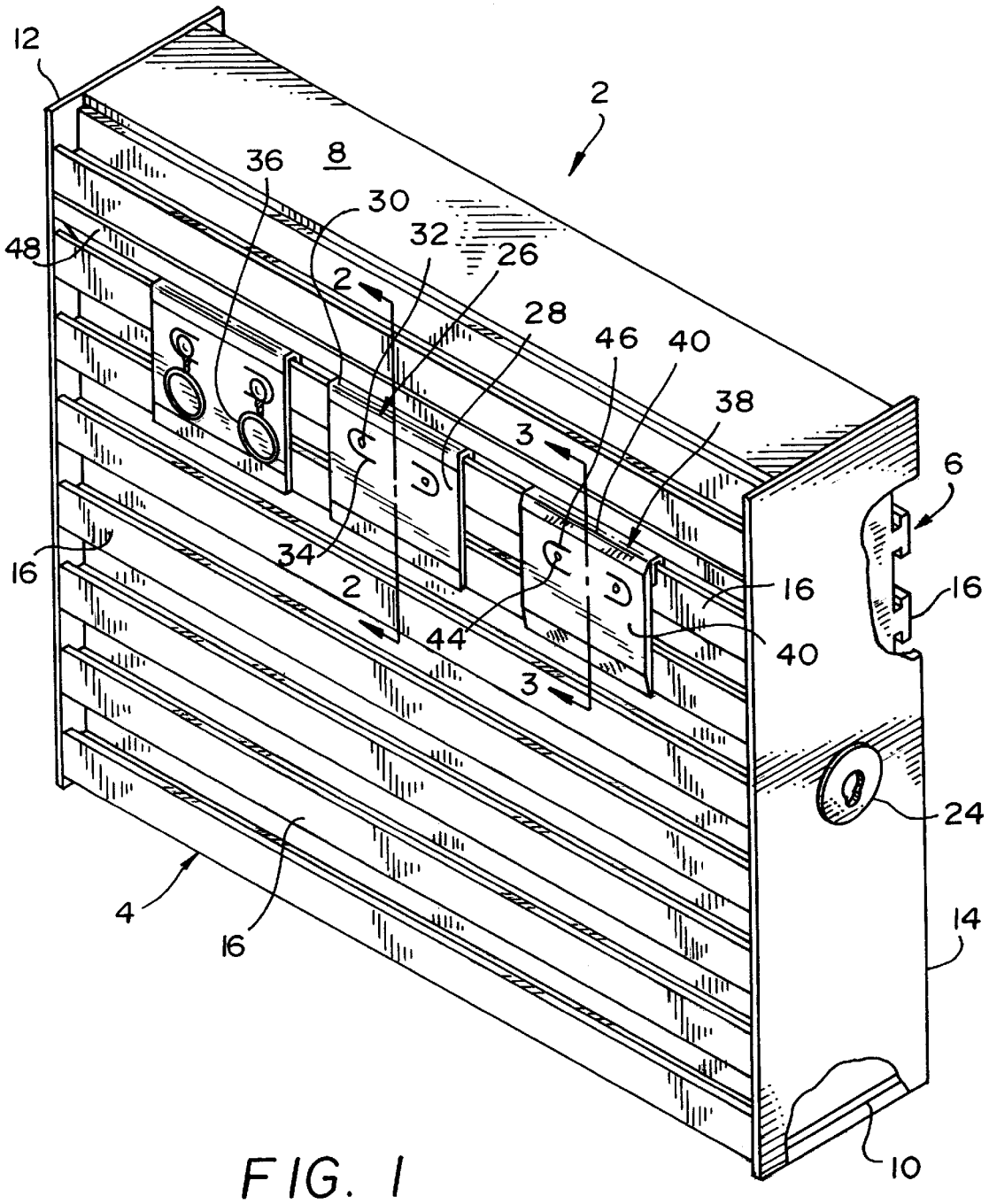
FIG. 1 is a perspective view of a merchandise display assembly made in accordance with the present invention.

FIG. 1 shows a perspective view of an embodiment of a merchandise display assembly or merchandise display fixture 2 made in accordance with the present invention. The display assembly 2 comprises a first display wall 4, a second display wall 6 disposed opposite to the wall 4, an upper base member 8, a lower base member 10, a side panel 12 and a side door 14 which are connected together to form a free standing box assembly. The display walls 4 and 6 comprises a plurality of profiles 16, which are preferably disposed in parallel configuration. The upper base member 8 and lower base member 10 respectively connect the top and bottom edges of the display walls 4 and 6. The side panel 12 covers one end of the profiles 16 and the door 14 covers the other end to advantageously cover the grooves formed between the flanges 16, as will be explained below. The side panel 12 is preferably fixedly attached to the display walls 4 and 6.

The side door 14 is vertically slidable to cover or expose the grooves formed between the profiles 16 of the respective display walls 4 and 6. The side door 14 generally includes a lock 24 for preventing unauthorized opening of the door 14. The door 14 is operably secured to the walls 4 and 6 by interlocking rails (not shown) or by other standard means, such as that used in drawer construction. The door 14 may also be slidable left or right by standard means, as long as the ends of the profiles 16 and 18 are covered or exposed when the door is closed or opened, respectively.

A standard display card 26 is attachable to any of the profiles 16. The standard display card 26 includes a face or display portion 28 and a hanger portion 30. The face 28 may include holes 32 and slots 34 for securing thereto an earring, jewelry, watches or other valuable articles 36. The present invention provides a locking mechanism to the standard display card 26, as will be described below. The display and hanger portions 28 and 30 are typically integrated as one unit, preferably made from a rigidly flexible plastic material.

Figure 3:
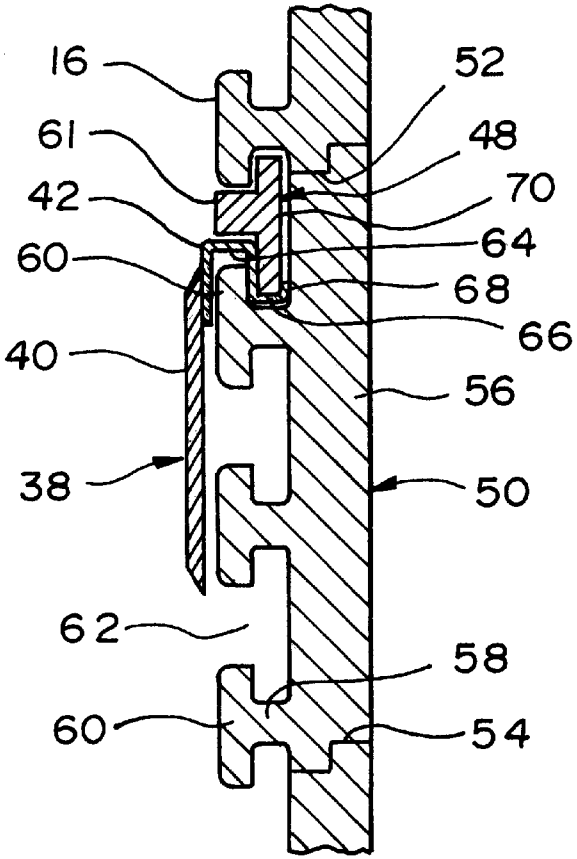
FIG. 3 is a cross-sectional view taken along line 3—3 of FIG. 1, showing an anti-theft display card made in accordance with the present invention.

An anti-theft display card 38 made in accordance with the present invention is disclosed in FIG. 3. The display card 38 is secured to the profiles 16. The display card 38 includes a face or display portion 40 and a hanger portion 42. Holes 44 and slots 46 may be included on the display portion 40 for securing thereto the item to be displayed. The hanger portion 42 is configured to fit the cross-sectional shape of the profiles 16, as will be discussed below.

The display assembly 2 includes locking bars 48 disposed between successive profiles 16. The locking bars 48 secure the respective hanger portions 30 and 42 of the display cards 26 and 38 to the profiles 16 and prevent the display cards from being readily removed therefrom. The profiles 16 and the locking bars 48 are configured such that each locking bar 48 may only be removed from the display assembly 2 when the side door 14 is opened, when the ends of the profiles 16 are exposed.

Figure 2:
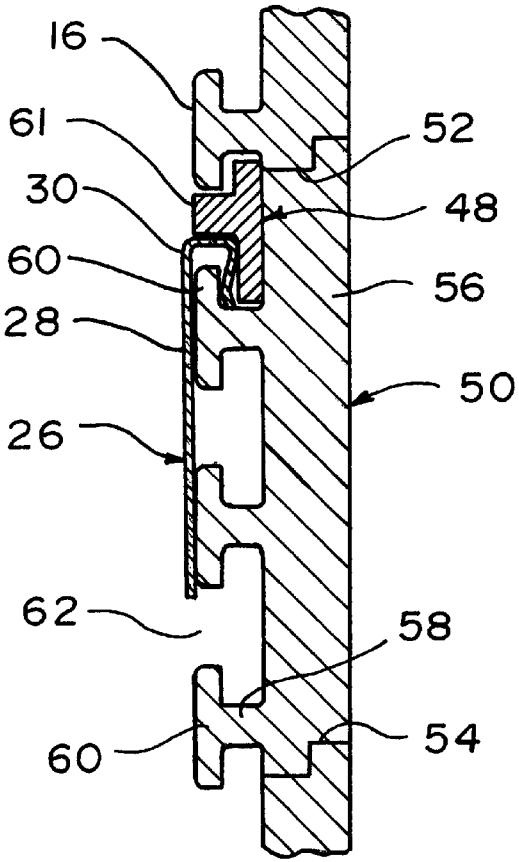
FIG. 2 is a cross-sectional view taken along line 2—2 of FIG. 1, showing a standard display card secured to the display assembly of the present invention.

FIGS. 2 and 3 show side views of the interfit between the respective display cards 26 and 38 to the profiles 16 and 18. Referring to FIG. 2, the display wall 4 typically comprises a plurality of units 50, each unit comprising a number of the profiles 16. Each unit 50 includes an upper edge 52 and a lower edge 54 such that the lower edge 54 of one unit 50 is stackable on the upper edge 52 of another unit 50. The display wall 6 is similarly configured.

Each unit 50 on the display wall 4 includes a base portion 56 and a number of profiles 16 connected to the base portion 56. The units 50 are commercially available with the base portion 56 and profiles 16 being typically integrated together as one unit. The units 50 are preferably arranged in parallel. Although each unit 50 is shown with three profiles 16, the number is not critical to the invention.

Each of the profiles 16 includes a rib portion 58 and a flange portion 60. The rib portion 58 extends from the base portion 56 in a substantially traverse manner. The flange portion 60 is generally positioned to the rib 58 portion in a transverse manner to define a T-shape profile 16. The spacing between successive profiles 16, as defined by the rib and flange portions 58 and 60, defines a groove 62 extending between one end to the other end of the profiles 16.

As best shown in FIG. 2, the hanger portion 30 of the display card 26 is hooked onto the flange portion 60. The hanger portion 30 is substantially U-shaped and resiliently biased inwardly such as to press around the flange portion 60 when secured thereto.

The locking bar 48 is disposed within the groove 62 when in use. The locking bar 48 is generally T-shape in cross-section for interfitting within the corresponding T-shaped groove 62 formed by adjacent profiles 16. The locking bar 48 is as long as the profile 16 so that the whole length of the groove 62 is filled by the locking bar 48. The flange portion 60 of the profiles 16 are configured such that the locking bar 48 is substantially restricted within the groove 62. Insertion or removal of the locking bar 48 into or from the groove 62 is possible only if the side door 14 is open to expose the ends of the flange 16.

The locking bar 48 is configured to restrict removal of the display cards 26 and 38 from the profiles 16. The locking bar 48 includes a leg portion 61 that occupies the space between adjacent flange portions 60 such that the leg portion 61 is substantially pressing on the hanger portions 30 and 42 of the display cards 26 and 38, thereby restricting lifting of the display cards 26 and 38 off the flange portion 60. Further, the side panel 12 and side door 14 restricts lateral sliding beyond the ends of the profiles 16, effectively making the display cards resistant to shop-lifting.

Referring to FIG. 3, a side view of the display wall 4 is shown with the anti-theft display card 38 interfit therewith.

The anti-theft display card 38 is configured to be more resistant to unauthorized removal than the standard display card 26. The hanger portion 42 of the lockable display card 38 includes a U-shaped section 64 that fits over the flange portion 60 and another U-shaped portion 66 that sits within the groove 62, as best shown in FIG. 3. The U-shaped portion 66 includes a terminal leg portion 68 that extends upwardly adjacent the base portion 56. Both U-shaped portions 64 and 66 may be integral with the display portion 40 and made from a rigid and flexible plastic material. The locking bar 48 has a base portion 70 that presses onto the U-shaped portion 66 when the locking bar 48 is inserted into the groove 62, thereby restricting lifting of the display card 40 from the profile 16. In addition, the leg portion 61 of the locking bar 48 presses on the other U-shaped portion 64, as in the case of the standard display card 26. Thus, the anti-theft display card 38, is more resistant to unauthorized removal than the standard display card 26.

Although the portion 66 is disclosed as being U-shaped, a person skilled in the art will understand that removing the leg portion leg portion 68, leaving the portion 66 L-shaped, will still provide additional tamper-resistance than the standard display card 28.

Referring now to FIG. 4, a perspective assembly view of the standard display card 26, the anti-theft display card 38 and the locking bar 48 is shown. The display cards 26 and 38 are first attached to the flange 16 by securing the respective hanger portions 30 and 42 onto the flange portion 60. The matching T-shaped locking bar 48 is then inserted into the groove 62 from the open end of the wall 4. The bar 48 advantageously has a tapered end 72, which is the forward end of the bar that rides over the U-shaped portion 66 of the display card 38, thereby facilitating insertion of the bar 48 into the groove 62, as best shown in FIG. 5.

Although the preferred embodiment of merchandise display assembly 2 is a rectangular box, other shapes is equally applicable in the present invention. Further, the display wall 4 or 6 need not be free-standing, but could equally be secured to a support structure, such as a wall, etc.

While this invention has been described as having a preferred design, it is understood that it is capable of further modification, uses and/or adaptations following in general the principle of the invention and including such departures from the present disclosure as come within known pertains, and as may be applied to the essential features set forth, and fall within the scope of the invention or the limits of the appended claims.

I claim:

1. A merchandise display assembly, comprising:

a) first and second longitudinal profiles defining a groove therebetween, each of said first and second profiles including a flange portion having an upper edge portion for securing thereto a hanger portion of a display card; and b) a member configured to be inserted into said groove, said member being sized to substantially fill up the cross-sectional space defined by said groove, said member including a leg portion configured to be disposed in a space formed between adjacent flange portions such that said leg portion is disposed over the display card hanger portion, thereby to restrict the display card from being lifted from said upper edge portion.

2. A merchandise display assembly as in claim 1, wherein:

said member and said groove are T-shaped in cross-section.

3. A merchandise display assembly as in claim 1, wherein:

one end of said member is tapered.

4. A merchandise display assembly as in claim 1, wherein:

each of said profiles is T-shaped in cross-section.

5. A merchandise display assembly as in claim 1, and further comprising:

a) one end of said groove is closed; and b) a door operably associated with the other end of said groove, such that the other end may be exposed at will to remove said member and thereby permit the display to be lifted from the profiles.

6. A merchandise display assembly as in claim 5, wherein:

said door is slidable.

7. A merchandise display assembly, comprising:

a) first and second display walls each having first and second ends, each having a plurality of profiles with adjacent profiles defining a groove therebetween, each of said plurality of profiles including a flange portion having an upper edge portion for securing thereto a hanger portion of a display card;

b) said first display wall being disposed opposite said second display wall in a spaced back-to-back configuration;

c) an end panel secured to one end of said first and second display walls such that said grooves are closed off;

d) an operable panel disposed at the other end of said display walls adapted to expose or close off said grooves; and e) a member configured to be inserted into one of said grooves, said member being sized to substantially fill up the cross-sectional space defined by said one of said grooves, said member including a leg portion configured to be disposed between a space formed between adjacent flange portions such that said leg portion is disposed over the display card hanger portion, thereby to restrict the display card from being lifted from said upper edge portion.

8. A merchandise display assembly as in claim 7, and further comprising:

a) an upper base member connected to top edges of said first and second display walls; and b) a lower base member connected to bottom edges of said first and second display walls.

9. A merchandise display assembly as in claim 7, wherein:

said member and said groove are T-shaped in cross-section.

10. A merchandise display assembly as in claim 7, wherein:

one end of said member is tapered.

11. A merchandise display assembly as in claim 7, wherein:

said profiles are T-shaped in cross-section.

12. A merchandise display assembly as in claim 7, wherein:

said panel is slidable.

13. A merchandise display assembly as in claim 7, wherein:

a) each of said first and second display walls includes at least first and second sections; and b) said first section is stacked on top of said second section.

14. A merchandise display system, comprising:

a) first and second longitudinal profiles defining a groove therebetween, each of said first and second profiles including a flange portion having an upper edge portion;

b) a display card having a display portion and a hanger portion;

c) said hanger portion having a first portion adapted to be secured to one of said upper edge portions, and a second portion adapted to be disposed within a groove formed between said first and second profiles; and d) a member configured to be received in said groove, said member including a leg portion configured to be disposed in a space formed between said flange portions such that said leg portion is disposed over said first portion, thereby to restrict the display card from being lifted from said upper edge portion.

15. A merchandise display system as in claim 14, wherein: said hanger portion is S-shaped.

16. A merchandise display system as in claim 14, wherein:

a) said first portion is an inverted U-shape; and b) said second portion is L-shaped.

17. A merchandise display system as in claim 14, wherein: said first and second portions are U-shaped.

18. A merchandise display system as in claim 14, wherein: said display portion and said hanger portion are integral as one unit.

* * * * *